United States Patent [19]

Osgood et al.

[11] Patent Number: 4,482,352

[45] Date of Patent: Nov. 13, 1984

[54] FUEL ADDITIVE

[75] Inventors: Gordon L. Osgood, Romeo; George G. Reinhard, Warren, both of Mich.

[73] Assignee: Fuel-X-Tender Corporation, Romeo, Mich.

[21] Appl. No.: 586,408

[22] Filed: Mar. 5, 1984

[51] Int. Cl.[3] ..... C10L 1/30

[52] U.S. Cl. ..... 44/53; 44/56; 44/57; 44/77; 44/78; 44/79; 44/67; 44/68; 44/76

[58] Field of Search ..... 44/53, 56, 57, 77, 78, 44/79, 67, 68, 76; 585/13, 14

[56] References Cited

U.S. PATENT DOCUMENTS

| | | | |
|---|---|---|---|
| 1,423,049 | 7/1922 | Tunison | 44/77 |
| 1,425,136 | 8/1922 | Rohrs | 44/77 |
| 2,068,635 | 1/1937 | Prutton | 44/79 |
| 2,151,432 | 3/1939 | Lyons et al. | 44/77 |
| 2,165,261 | 7/1939 | Hewlett et al. | 44/77 |
| 2,176,747 | 10/1939 | Schneider et al. | 44/77 |
| 2,218,135 | 10/1940 | Moser | 44/57 |
| 4,298,351 | 11/1981 | Earle | 44/77 |
| 4,376,636 | 3/1983 | Weinberger | 44/56 |

*Primary Examiner*—Mrs. Y. Harris-Smith

*Attorney, Agent, or Firm*—Fisher, Crampton, Groh & McGuire

[57] ABSTRACT

A novel nonacidic fuel additive which is soluable in gasoline, diesel fuels and other liquid aliphatic hydrocarbons, and which comprises the product produced by mixing ketone peroxides, ketones, a Group III metal, an alcohol, and borontrifloride, or liquid cobalt, or a chlorobenzine. The fuel additive further comprises a ketone solvent, said ketones preferrably being methyl ethyl ketones and their peroxides and solvents. The fuel additive of the present invention, serves to increase power output, lower the ignition point of the carrier fuel, increase mileage, and, especially when used with diesel, reduces the effect of cold temperatures on the viscosity, turbidity, and color of the diesel fuel to temperatures as severe as −40° C.

17 Claims, No Drawings

FUEL ADDITIVE

This invention relates to a nonacidic fuel additive for carrier fuel to increase power output, lower ignition point of the carrier fuel, increase mileage and reduce the effect of cold temperatures on viscosity of the carrier fuel. The fuel additive of the present invention may also be added to lubricating fluids in order to reduce the effect of cold temperatures on the viscosity of those fluids. The fuel additive is contemplated for use with internal combustion engines, both the gasoline type and the diesel type.

The prior art fuel additives are directed, for the most part, to blends of various alcohols with petroleum distillates to be added to a carrier fuel. In addition, the use of various borane compounds as disclosed in U.S. Pat. No. 4,201,553 to Osborg and ketones in conjunction with alcohols as disclosed in U.S. Pat. No. 4,376,636 to Weinberger have also been disclosed in the prior art. However, none of the known prior art possesses the cold temperature resistant properties of the present invention and none, insofar as is known, are nonacidic in nature. Finally, none of the prior art, insofar as is known, discloses the use of its fuel additive as a means to increase the life of lubricating fluids by eliminating the effects of acid build up in engines, thereby endangering its lubricating qualities.

Accordingly, it is one object of the present invention to provide an additive for carrier fuels which will enable the user to fuel an internal combustion engine and enhance mileage, power output, lower the ignition point of the fuel, and reduce the effects of cold temperatures upon the properties of the carrier fuel.

It is a further object of the present invention to provide a nonacidic fuel additive which will prolong the life of the engine and fuel system and lubricating fluids within the vehicle engine, thereby greatly extending the life of the vehicle while reducing potential maintenance costs.

The fuel additive of the present invention is a nonacidic mixture added to a carrier fuel which increases power output, lowers the ignition point of the carrier fuel, increases mileage and reduces the effects of cold tempertures on the viscosity properties of the carrier fuel. The additive is comprised of a ketone peroxide, a ketone, an alcohol, a Group IV metal, a borontrifloride, or chlorobenzine or liquid cobalt. These ingredients are mixed together in various proportions and ranges whereby, depending upon the use to which the additive is to be applied, the additive of the present invention may be used with diesel fuel, gasolines, turbine fuels, and as an additive to lubricating fluids. Because the additive is nonacidic in nature and allows for a more complete combustion by the internal combustion engine, the fuel additive contributes to a prolonged engine life as well as a prolonged interval between changing of lubricating fluids, for the reason that acid build up within the system is reduced to a minimum.

The additive of the present invention is comprised of a ketone peroxide, a ketone, a Group IV metal, an alcohol, and an ignition enhancer taken from the group borontrifloride, chlorobenzine, or liquid cobalt. The fuel additive, depending upon its use, may also include a kerosene for use with diesel fuels.

Inasmuch as the additive is contemplated for use in both gasoline and diesel fuels as a carrier fuel, there are necessarily slight differences in the compositions of the respective additives. However, the effect of each additive with respect to the internal combustion engine is the same and it should be kept in mind that each additive may be used in a wide range of fuels within their respective classes.

The fuel additive for gasoline is comprised of a ketone peroxide from the group acetone or methyl ethyl ketone or a mixture of the two, in an amount of approximately 10 percent to approximately 45 percent by volume of the fuel additive, a ketone selected from the group acetone or methyl ethyl ketone in an amount of approximately 15 percent to 50 percent by volume of the additive, a Group III metal from the group comprising boron, aluminium, gallium, indium or thallium, and preferably thallium, in an amount of approximately 30 percent by volume of the fuel additive, and either borontrifloride in an amount of approximately 5 percent to 8 percent by volume of the fuel additive or liquid cobalt in an amount of approximately 5 percent by volume of the fuel additive and used in conjunction with the borontrifloride, or chlorobenzine in an amount of approximately 20 percent by volume of the additive and which may be used in conjunction with the borontrifloride and liquid cobalt.

Methyl ethyl ketone peroxide is a peroxide of 3-propanone and is used to lower the boiling point of the carrier fuel to provide a quicker, more uniform ignition at a lower flash point as well as to enhance the oxygen content within the combustion chamber to provide a more complete combustion of the fuel. Further, methyl ethyl ketone enhances the explosive tendency of the fuel because peroxides are naturally unstable and explosive in general.

Methyl ethyl ketones are used in the present invention in a manner similar to that occupied by alcohols in the prior art; specifically, methyl ethyl ketone has a lower boiling point and therefore a lower ignition point than the alcohols of similar or identical carbon content and weight. For example, methyl ethyl ketone has a boiling point of 79.6° C. as compared to the boiling point of secbutyl alcohol which is 99.5° C. Further, methyl ethyl ketone will release a greater caloric output than alcohols of similar or identical carbon content in weight thereby contributing to the overall improvement in combustion efficiency of a fuel which is mixed with the additive.

Methyl ethyl ketone solvents are esters of methyl ethyl ketones and are used as a thinning additive for the carrier fuel. The methyl ethyl ketone solvent further aids in cleaning the engine during combustion, thereby preventing a bluid up of sticky tars and varnishes along the valves, valve seats and cylinder walls of the engine. The thinning action of the methyl ethyl ketone is such that the fuel is rendered resistant to the effects of cold temperatures as will hereinafter be shown by way of example. Finally, the methyl ethyl ketone solvents serve to aid in blending the entire composition of the additive into one homogeneous fluid solution for use as a fuel additive.

A Group III metal from the group comprising boron, aluminium, gallium, indium or thallium is used as an anti-knock additive to the fuel. Preferably thallium is used as the anti-knock component of the present composition because it has many properties similar to lead and is not nearly as toxic as lead. In addition, thallium will not "poison" the catalytic converters of today's automobiles. The thallium is added in powdered form as an anti-knock element in any number of a variety of alkyl compounds which serve to improve the octane or cetane rating of the carrier fuel. In addition, it appears that the thallium acts to become a salt of the methyl ethyl ketone compounds which are reacted during combustion within the engine, thereby precluding formation of acids in the engine which would result in corrusion and wearing of the internal components of the engine. Further, because the fuel additive is rendered nonacidic, the lubricating fluids within the engine have a longer life in that they are not subject to the break down effects of the acids. Thus, with the addition of thallium, the fuel is rendered nonacidic and contributes to reduced maintenance costs and longer life of an engine.

Borontrifloride is added as a stabilizer in the hydrocarbon fuel mixture to enhance the octane and decatane and cetane rating of the carrier fuel. In this respect, borontrifloride acts to raise ignition point of the entire fuel additive to allow for an even, uniform ignition of the fuel. This may seem in contrast and in direct opposition to the effect of the methyl ethyl ketones and their peroxides and solvents. However, the use of the borontrifloride serves to raise the ignition point of the fuel but the action of the methyl ethyl ketones, peroxides and solvents is to lower it, thereby providing for a fuel which has a lower ignition point than a fuel without the additives, and yet is not so low as to be subject to preignition explosion.

Although it is conceivable to use liquid cobalt in the fuel additive in the same manner as borontrifloride, it should be added that liquid cobalt is extremely corrosive and reactive, and as such, must be carefully monitored within the additive so as not to upset the nonacidic properties of the additive of the present invention. Therefore, liquid cobalt must be added in extremely limited ranges not to exceed approximately 5 percent by volume of the fuel additive. The liquid cobalt may be added when it is desired to greatly enhance the explositivity of the carrier fuel.

Chlorobenzine, preferably orthochlorobenzine or parachlorobenzine may be added to the fuel additive in order to enhance the octane rating of the fuel. However, chlorobenzine is a highly reactive acidic compound and must be added, if at all, within a narrow range of not greater than 20 percent by volume of the fuel additive.

An alcohol, either methanol, up to approximately 50 percent, or ethanol, from 3 percent to 60 percent, is added to lower the ignition point of the fuel additive and raise the octane rating of the fuel itself. In addition, the alcohols and methyl alcohol particularly, act as additional freezing preventatives.

There are several preferred mixture constituents for fuel additives and these differ from each other, depending upon the carrier fuel to which they are to be added. Preferably, the fuel additive to gasoline is comprised of approximately 45 percent methyl ethyl ketone peroxide, 30 percent thallium, 2 percent methanol, 15 percent methyl ethyl ketone solvent and 8 percent of borontrifloride. This fuel additive is contemplated for use with a carrier fuel in a ratio of 1 part additive to 1,000 parts of fuel.

In addition to the above described percentages of each of the various constituents of the fuel additive which is the subject of the present invention, the additives may also be formulated such that it has 35 percent methyl ethyl ketones, 30 percent thallium, 10 percent methyl ethyl ketone peroxide, 2 percent methanol, 15 percent methyl ethyl ketone solvent and 8 percent borontrifloride. Again, each of the various constituents would serve as described above and as is the case with the above-described fuel mixture, this combination of additives should be added to a 1:1,000 ratio with the carrier fuel.

The diesel fuel additive contemplated by this invention is similar to the gasoline additive. Specifically, it is contemplated that a fuel additive comprising 40 percent methyl ethyl ketone peroxide, 25 percent methyl ethyl ketone solvents, 3 percent ethanol, 22 percent kerosene, and 10 percent borontrifloride be added to diesel fuel in a ratio of preferably 1:393, and may be used as great as 1:150 mixture ratio with the diesel fuel. The diesel fuel additive may be used with all grades of diesel fuel. The additive, especially that used by the diesel fuel, controls viscosity changes at lower temperatures and reduces the effect of cold temperatures on viscosity, color and turbidity of diesel fuel.

The following examples are offered in order to more fully illustrate the invention, but are not to be construed as limiting in scope thereof.

EXAMPLE I

Samples of the gasoline and diesel fuel additives as described in the specification were subjected to laboratory testing in order to determine whether the additives were acidic or not. The results of the tests showed both samples to be nonacidic in nature.

EXAMPLE II

Two samples of number 2 diesel fuel were studied to determine the effect of cold on color, flow and jelling. The first sample was treated with the diesel fuel additive in a ratio of approximately 22 gallons of fuel to 7 ounces of diesel fuel additive. Both the treated and untreated samples were chilled to below −40° C. (−40° F.). The untreated fuel darkened and became cloudy and viscous at that temperature. The treated fuel did not darken or cloud at that temperature but started to thicken and the thickening observed in the treated fuel at −40° C. was similar to that seen in the untreated fuel at −25° C. (−13° F.). Thus, although the viscosity was affected at −40° C., the change in viscosity was similar to that of untreated fuel at −25° C., thereby evidencing a great resistance to the effects of cold on viscosity.

While certain representative embodiments and details have been shown for the purpose of illustrating the present invention, it will be apparent to those skilled in the art that these changes and modifications to be made therein without departing from the spirit and scope of the invention.

It is claimed:

1. A nonacidic fuel additive for carrier fuels to increase power output, lower ignition point of the carrier fuel, increase mileage and reduce the effect of cold temperatures on the viscosity of the carrier fuel, said fuel additive comprising:

(a) methyl ethyl ketone peroxide in an amount ranging from approximately 10 percent to approximately 45 percent by volume of fuel additive;

(b) methyl ethyl ketone in an amount of approximately 15 percent to approximately 50 percent by volume of fuel additive;

(c) thallium in an amount of approximately 30 percent by volume of the fuel additive;

(d) methyl alcohol in an amount of approximately 2 percent by volume of the fuel additive; and (e) borontrifloride in an amount of approximately 8 percent by volume of the fuel additive.

2. The fuel additive of claim 1 further comprising methyl ethyl ketone solvent in an amount of approximately 15 percent by volume of the fuel additive.

3. The fuel additive of claim 2 wherein said carrier fuel is gasoline.

4. The fuel additive of claim 3 wherein said fuel additive is added to the carrier fuel in a 1 to 1,000 mixture ratio.

5. The fuel additive of claim 1 wherein said fuel additive is added to the carrier fuel in a 1 to 1,000 mixture ratio.

6. A nonacidic fuel additive for carrier fuels to increase power output, lower ignition point of the carrier fuel, increase mileage and reduce the effect of cold temperatures on the viscosity of the carrier fuel, said fuel additive comprising:

(a) methanol in an amount of approximately 50 percent by volume of the fuel additive;

(b) chlorobenzine in an amount of approximately 20 percent by volume of the fuel additive;

(c) methyl ethyl ketone peroxide in an amount of approximately 8 percent by volume of the fuel additive;

(d) methyl ethyl ketone solvent in an amount of approximately 12 percent by volume of the fuel additive;

(e) borontrifloride in an amount of approximately 5 percent by volume of the fuel additive; and (f) liquid cobalt in an amount of approximately 5 percent by volume of the fuel additive.

7. The fuel additive of claim 6 wherein said chlorobenzine is orthochlorobenzine or parachlorobenzine.

8. The fuel additive of claim 6 wherein said carrier fuel is gasoline.

9. A nonacidic fuel additive for carrier fuels to increase power output, lower ignition point of the carrier fuel, increase mileage and reduce the effect of cold temperatures on the viscosity of the carrier fuel, said fuel additive comprising:

(a) methyl ethyl ketone peroxide in an amount of approximately 5 percent to 40 percent by volume of the fuel additive;

(b) methyl ethyl ketone solvent in an amount of approximately 10 percent to 40 percent by volume of the fuel additive; and (c) ethanol in an amount of approximately 3 percent to 60 percent by volume of fuel additive.

10. The nonacidic fuel additive of claim 9 further comprising kerosene in an amount of approximately 22 percent to 30 percent by volume of the fuel additive.

11. The nonacidic fuel additive of claim 10 further comprising borontrifloride in an amount of approximately 10 percent by volume of fuel additive.

12. The nonacidic fuel additive of claim 9 further comprising methyl ether in an amount of approximately 5 percent by volume of the fuel additive.

13. The nonacidic fuel additive of claim 9 further comprising borontrifloride in an amount of approximately 10 percent by volume of fuel additive and chlorobenzine in an amount of approximately 25 percent by volume of fuel additive.

14. The nonacidic fuel additive of claim 9 wherein said carrier fuel is diesel fuel.

15. The nonacidic fuel additive of claim 14 wherein said diesel fuel is diesel fuel number 2.

16. The fuel additive of claim 15 wherein said additive mixed with the carrier fuel is approximately a 1:150 ratio.

17. The fuel additive of claim 15 wherein said additive is mixed with the carrier fuel in approximately a 1:393 ratio.

* * * * *